US005339481A

United States Patent [19]

Hoagland

[11] Patent Number: 5,339,481

[45] Date of Patent: Aug. 23, 1994

[54] SCRUB BRUSH

[75] Inventor: Mary M. Hoagland, Cincinnati, Ohio

[73] Assignee: Vining Industries, Inc., Springfield, Ohio

[21] Appl. No.: 2,616

[22] Filed: Jan. 11, 1993

[51] Int. Cl.[5] ..... A47L 13/12; A46B 5/02

[52] U.S. Cl. ..... 15/111; 15/143.1; 15/159.1; 15/236.01; D4/118; D4/129; D4/138

[58] Field of Search ..... 15/159.1, 111, 143.1, 15/145, 244.1, 235.4, 235.5, 235.6, 235.8, 236.01; 16/110 R, 114 R; 51/205 R, 392, 393, 118; D4/129, 130, 138

[56] References Cited

U.S. PATENT DOCUMENTS

| | | | |
|---|---|---|---|
| D. 185,466 | 6/1959 | Scholl . | |
| D. 209,130 | 11/1967 | Brookes . | |
| D. 240,473 | 7/1976 | Parker . | |
| D. 266,458 | 10/1982 | Gonsalves . | |
| D. 269,565 | 7/1983 | Goldstaub | D4/129 |
| D. 274,388 | 6/1984 | Colemore-Williams . | |
| D. 274,389 | 6/1984 | Colemore-Williams . | |
| 398,864 | 11/1921 | Kelly . | |
| 1,026,233 | 5/1912 | Zacsek | 16/114 R |
| 1,377,215 | 5/1921 | Miller | 15/111 |
| 1,796,249 | 3/1931 | Gillaspy | 16/114 R |
| 4,466,309 | 8/1984 | Matey | 16/114 R |
| 4,543,680 | 10/1985 | Vlahos | 15/145 |

FOREIGN PATENT DOCUMENTS

| | | | |
|---|---|---|---|
| 287861 | 10/1915 | Fed. Rep. of Germany | 15/111 |
| 1507629 | 11/1967 | France | 15/235.4 |
| 9399 | 1/1907 | United Kingdom | 15/143.1 |
| 606463 | 8/1948 | United Kingdom | 16/110 R |

*Primary Examiner*—Timothy F. Simone
*Assistant Examiner*—Randall E. Chin
*Attorney, Agent, or Firm*—Panitch, Schwarze, Jacobs & Nadel

[57] ABSTRACT

A scrub brush intended primarily for hands and knees type scrubbing. The scrub brush has a substantially rectangular bristle block body of substantially uniform thickness. The bristle block has a rearward end and a forward end with a forwardly extending scraper thereon, terminating in a scraping edge extending transversely of the bristle block. The brush bristles extend downwardly from the bottom surface of the bristle block. A handle for the scrub brush comprises a grip extending longitudinally of the bristle block and a pair of supports which extend between the bristle block top surface and the grip near its forward and rearward ends. The grip has a gentle, longitudinal S-curve with the result that the grip forward end is spaced at a slightly greater distance from the upper surface of the bristle block than is the grip rearward end. The grip increases slightly in width and thickness from its rearward end to its rounded forward end. The configuration of the handle permits the brush to be grasped by the user's hand in a number of ways with the forward end of the bristle block facing toward or away from the user, and assures that the heel of the user's hand applies the bulk of the scrubbing force.

14 Claims, 4 Drawing Sheets

SCRUB BRUSH

TECHNICAL FIELD

The invention relates to a scrub brash, and particularly to a scrub brush having an improved handle which greatly facilitates its effectiveness and ease of use.

BACKGROUND ART

The present invention is directed to a scrub brush intended primarily for hands and knees type scrubbing. Scrub brushes for this purpose are old and well-known in the art. Perhaps the most frequently encountered scrub brush comprises a wooden, block-like body having a plurality of scrubbing bristles extending downwardly from its underside. A problem with this type of brash lies in the fact that the user must not only expend effort in the scrubbing operation, but also must engage the sides of the brush body with considerable force to keep the brush from slipping out of the user's hand. In order to ease this problem, brushes have been devised wherein the block-like body is provided along its side edges with recesses adapted to receive the thumb and fingers of the user. An example of this type of brush is taught in U.S. Pat. No. 1,398,864. It is not uncommon, however, for the user to scrape his knuckles on the surface being scrubbed when using brushes of this general type.

To further improve the engagement of the brash by the user's hand, prior art workers have devised a number of scrub brushes with handle means. U.S. Pat. No. D. 266,458 is exemplary of prior art patents teaching handled scrub brushes.

The present invention is directed to an improved scrub brush and handle combination wherein the handle has a grip portion spaced upwardly from the brush body. The grip portion has a longitudinal configuration in the form of a shallow S-curve whereby the forward end of the handle grip is spaced from the top surface of the brash body by a distance slightly greater than is the rearward end of the grip. The thickness of the handle grip increases from its rearward end toward its forward end, as does its width. By virtue of its configuration, the handle of the present invention may be grasped by the user's hand in a number of ways and with either end of the brash extending forwardly of the user's hand. This flexibility of hand positioning allows the user to change from time-to-time to keep weariness from hand strain to a minimum.

The grip portion of the scrub brush handle is high enough to protect the user's knuckles from scrapping the surface being scrubbed. On the other hand, the grip is sufficiently wide and low to add stability to the brush during the scrubbing operation. No matter which end of the brash extends forwardly of the user's hand, the grip provides a comfortable rest for the heel of the user's hand, allowing the heel of the user's hand to apply direct pressure for easier and more natural hands and knees type scrubbing.

The brush and its handle arrangement are such that the user's hand can engage the brash in several "no-grip" ways, for those users whose hand are physically impaired, arthritic, or the like.

DISCLOSURE OF THE INVENTION

According to the invention there is provided a handled scrub brush intended primarily for hands and knees type scrubbing. The brash has a bristle block which is substantially rectangular and which is substantially uniform in thickness. The bristle block has longitudinal sides, a rearward end, and a forward end with a forwardly extending scraper thereon. The scraper terminates in a scraping edge oriented transversely of the bristle block. The brash bristles extend downwardly from the bottom surface of the bristle block.

The scrub brash of the present invention is provided with a handle which comprises a grip and a pair of supports which extend between the bristle block top surface and the grip near its forward and rearward ends. The grip extends longitudinally of the bristle block and has a rounded forward end near the forward end of the bristle block and a rearward end near the rearward end of the bristle block. The grip has a gentle, longitudinal S-curve with the result that the grip forward end is spaced from the top surface of the bristle block by a distance slightly greater than is the grip rearward end. From its rearward end to its forward end the grip increases in width and in thickness. The forward longitudinal half of the grip, up to its curved end, may be provided with a series of transverse grooves which also extend down the longitudinal sides of the grip, enabling a more positive grip by the user's hand. The configuration of the handle enables the brush to be grasped in a number of ways, whether the forward end of the bristle block is facing toward or away from the user and even enables some "no-grip" engagements between the user's hand and the brush, as will be described hereinafter. Further, the handle and the configuration of its grip assures that the heel of the user's hand applies the bulk of the scrubbing force.

DETAILED DESCRIPTION OF THE DRAWINGS

Figure 1:
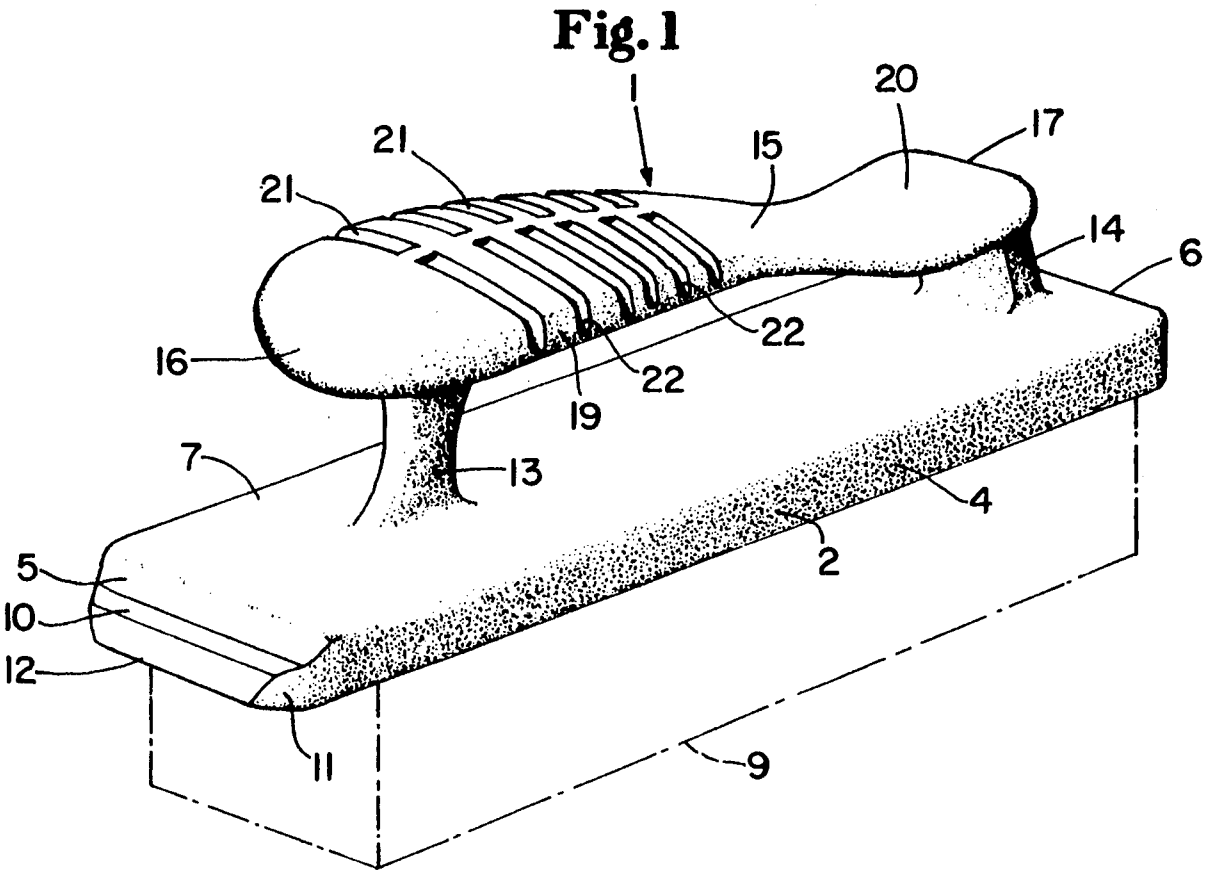
FIG. 1 is a top, front and left side perspective view of the scrub brush of the present invention with the bristles indicated by broken lines.

Reference is first made to FIGS. 1–4. In these Figs., the scrub brush of the present invention is generally indicated at 1. The scrub brush 1 comprises a substantially rectangular body or bristle block 2 having substantially rectilinear sides 3 and 4, slightly curved forward and rearward ends 5 and 6, and substantially planar top and bottom surfaces 7 and 8. A conventional array of scrubbing bristles extend downwardly from the bottom surface 8 of the bristle block 2 and are indicated by broken lines at 9.

Figure 3:
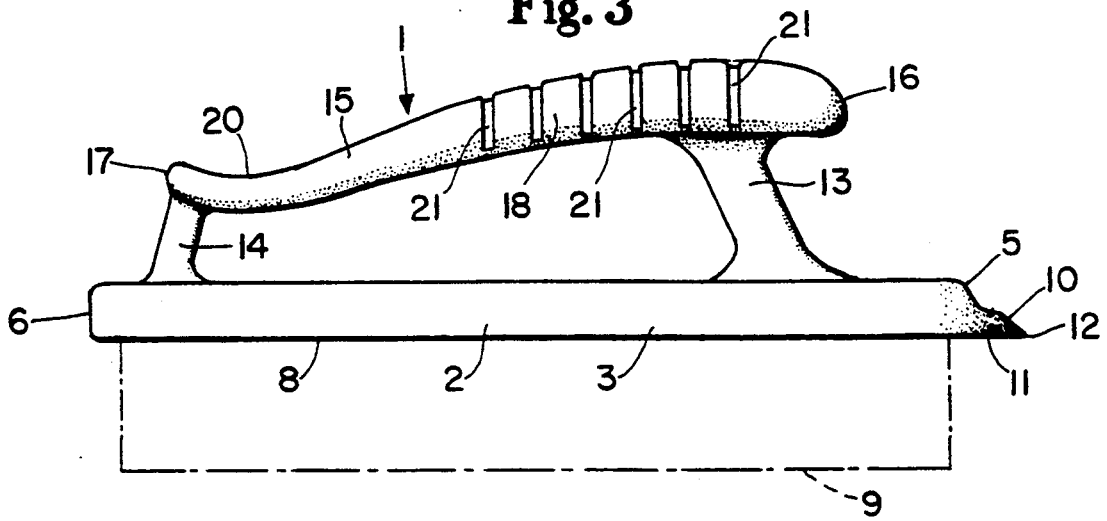
FIG. 3 is a right side elevational view of the scrub brush of FIG. 1 with the bristles shown in broken lines.

As can best be seen in FIG. 3, the forward end 5 of the bristle block 2 curves downwardly and forwardly to a downwardly and forwardly sloping surface 10 which meets an extension of the bristle block bottom surface 8 defining a scraper 11 having a forward scraping edge 12. The scraping edge 12 extends substantially transversely of the bristle block, and the scraper 11 and its scraping edge 12 can be used to remove heavy soil in an area, prior to scrubbing that area.

The scrub brush 1 is provided with a handle comprising forward and rearward supports 13 and 14 extending upwardly from the top surface 7 of the bristle block 2 and mourning a grip 15.

Figure 2:
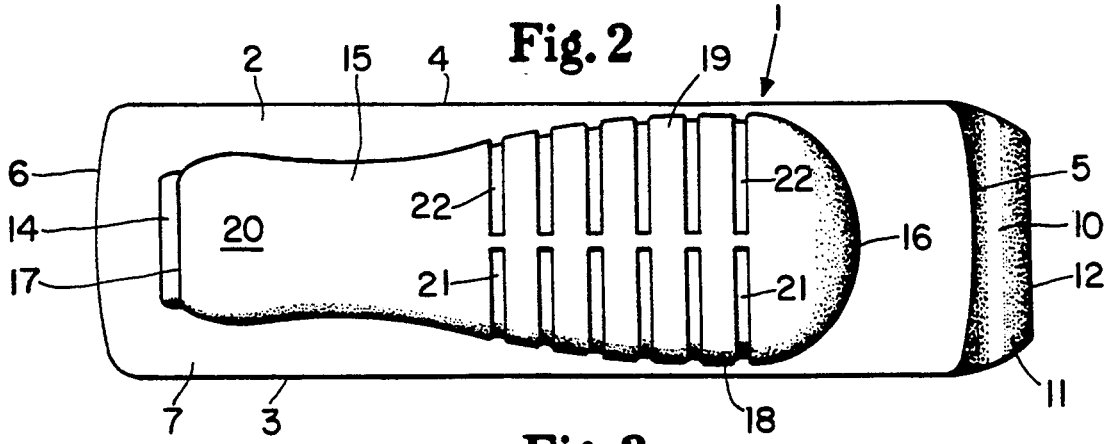
FIG. 2 is a plane view of the scrub brush of FIG. 1.

As viewed from the top in FIG. 2, the grip 15 has a rounded forward end 16, and a blunt, substantially rectilinear, rearward end 17. As is apparent from FIG. 2, grip 15 extends longitudinally of the bristle block 2 with its curved forward end 16 spaced inwardly from the slightly curved forward end 5 of the bristle block and its substantially rectilinear rearward end 17 spaced inwardly from the slightly curved rearward end of 6 of the bristle block. FIG. 2 clearly indicates that the sides 18 and 19 of the grip 15 from the rounded end 16 toward the rearward end 17 narrow, except for a slight bulge adjacent the rearward end 17, forming a finger rest surface 20, as will be further described hereinafter.

Figure 4:
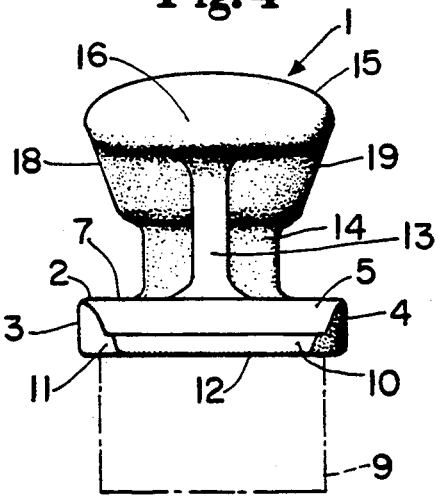
FIG. 4 is a front elevational view of the scrub brush of FIG. 1 with the bristles shown in broken lines.

It will be noted from FIGS. 2 and 4 that the grip 15 is quite wide, the forward portion of the grip being nearly as wide as the bristle block 2 and the rearward portion of the grip having a width greater than half the width of the bristle block 2.

As shown in the side elevational view of FIG. 3, the forward end 16 and the rearward end 17 are, in side elevation, rounded. The same is true of sides 18 and 19, as is clear from FIGS. 1 and 4. As is best seen in FIG. 3 and as is also clear from FIG. 1, the grip 15 has a gentle, longitudinal S-shaped configuration with the result that the forward end 16 of the grip is slightly higher above the top surface 7 of the bristle block than is the rearward end 17. In other words, support 13 is slightly taller than support 14. This gentle longitudinal S-shaped configuration contributes greatly to the utility and comfort of the scrub brush grip 15 as will be apparent hereinafter.

The support portions 13 and 14 of the handle 1 are sufficiently tall to enable the user's fingers to enter between the bottom surface of grip 15 and the top surface 7 of the bristle block 2. At the same time, the supports 13 and 14 are sufficiently short that the brash 1 has marked stability when grasped by the grip 15 during a scrubbing operation. The support 14 is nearly as wide as that part of the grip 15 it supports, adding to the stability of the brash 1. The support 13 is narrower with the result that the grip forward end 16 overhangs support 13 on all sides thereof so that the user's fingers can extend about the grip forward end 16, as will be described hereinafter. The support 13 is relatively wide from to rear, tending to spread the scrubbing forces over the bristle array. The relatively wide grip 15 provides a very comfortable rest or surface for the heel of the user's hand enabling direct pressure of the heel of the hand for natural hands and knees scrubbing, when the brash 1 and grip 15 are held with the forward end 5 of the brush facing forwardly or facing rearwardly. The grip 15 and its height from the upper surface 7 of the bristle block 2 further acts to keep the user's knuckles from scraping the surface being scrubbed.

The forward portion of the grip may on its sides 18 and 19 and its upper surface be provided with shallow transverse grooves to provide a comfortable frictional engagement between the user's hand and grip 15. An exemplary arrangement of such grooves is illustrated in FIGS. 1, 2 and 3. To this end, a first set of grooves 21 is provided. The grooves 21 extend vertically along the side 18 of grip 15 and transversely partway across the upper surface of grip 15. In a similar fashion, a second set of grooves 22 is provided. The grooves of this set extend vertically along the grip side 19 and partway across the upper surface of the grip 15. It will be noted from FIGS. 1 and 2 that corresponding grooves 21 and 22 of the sets thereof are opposed, but do not quite meet at the longitudinal center of grip 15. While not shown in the drawings, it is within the scope of the invention to provide selected surfaces of the grip 15 and bristle block 2 with textured surface areas, if desired. It is contemplated that the bristle block 2, scraper 11, supports 13 and 14 and the grip 15 lend themselves well to be molded as a single, integral, one-piece structure.

An advantage of the structure just described lies in the fact that the user's hand may grasp the brash and its handle in a number of different ways and with either end 5 or 6 of the bristle block 2 facing in a forward direction. This flexibility of hand positioning allows the user to change often to keep weariness from hand strain to a minimum.

Figure 5:
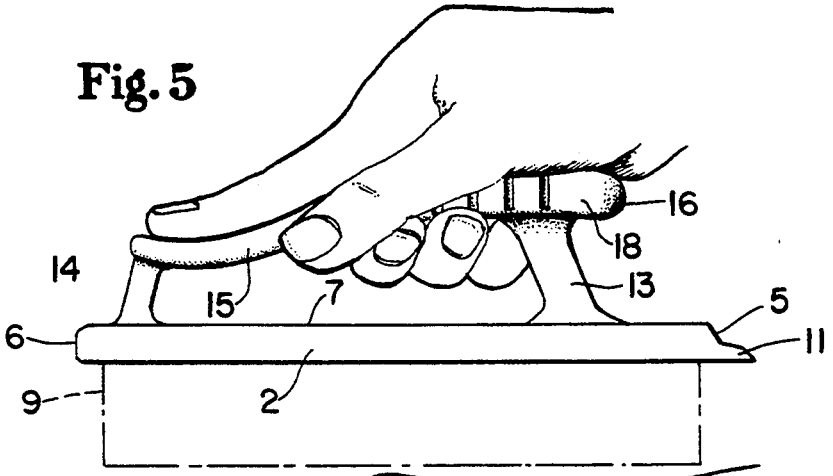
FIGS. 5, 6, 7 and 8 are side elevational views of the scrub brush of the present invention illustrating exemplary ways in which the brush may be grasped by the user's hand.

An exemplary grasp of the brush is illustrated in FIG. 5. In this instance, the rearward end 6 of the bristle block 2 is directed forwardly. The heel of the user's hand rests upon the widest portion of grip 15 near its end 16. The index finger extends along the top surface of the grip 15 with its forwardmost end abutting the finger rest portion 20 (see FIGS. 2 and 3). The remaining fingers of the user's hand are wrapped about the longitudinal grip edge 19 and the thumb of the user's hand is located along the grip longitudinal side 18.

Figure 6:
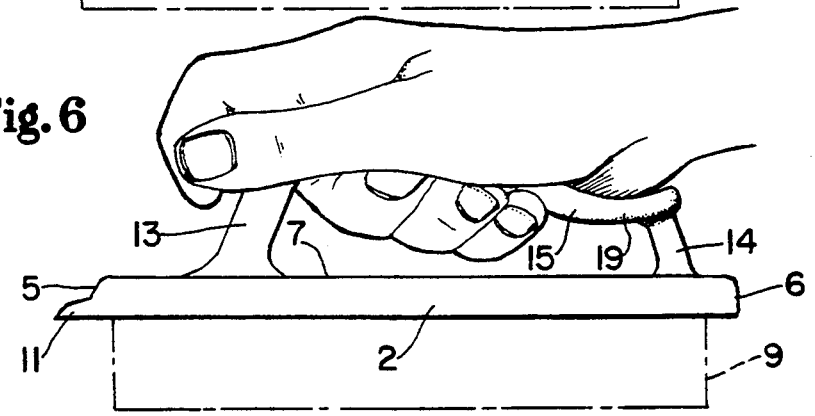

Another exemplary manner in which the brash may be grasped is illustrated in FIG. 6. In this instance, the forward end 5 of the bristle block and the scraper 11 are directed forwardly of the user's hand. The heel of the user's hand is in abutment with the rearward half of the grip 15. The user's thumb is engaged along the grip side 19 and the user's fingers are wrapped about the grip side 18 and extend beneath the grip 15. For additional, directional control, it may be preferred to wrap the index finger about the forward end 16 of the grip, as shown in FIG. 6.

Figure 7:
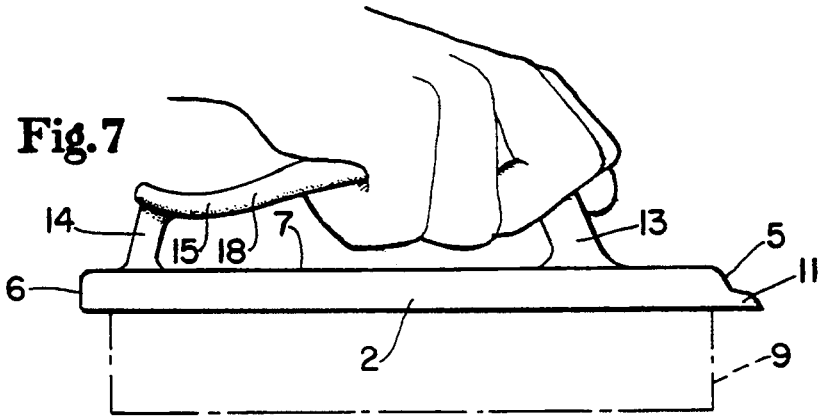

The exemplary grasp of the brush illustrated in FIG. 7 is similar to that of FIG. 6. In this instance, however, the hand is shifted slightly forwardly on the grip 15 with the user's thumb, index finger and middle finger engaged about the forward end 16 of the grip. The remaining fingers are wrapped about the grip edge 18 and extend beneath the grip.

Figure 8:
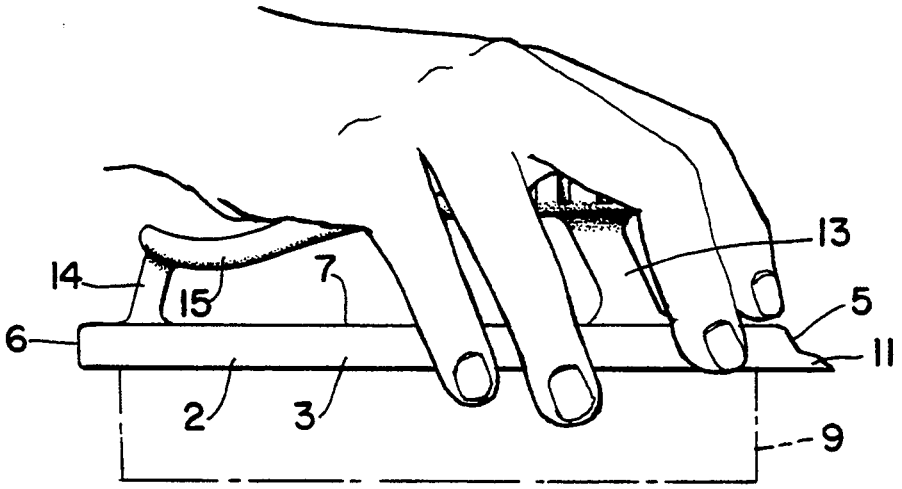

FIG. 8 illustrates a manner of grasping wherein the heel of the user's hand rests upon the top surface of grip 15. The user's thumb engages the longitudinal side 4 of the bristle block 2, and the user's middle, ring and small fingers engage the side 3 of the bristle block. The user's index finger extends over the forward end 16 of grip 15 and engages the top surface 7 of the bristle block near the forward end 5 and scraper 11. While this manual engagement, like those previously described, can conveniently be used during the scrubbing operation, it is also advantageously used during a scraping operation, the index finger helping to maintain the proper position and direction of the scraper.

Figure 9:
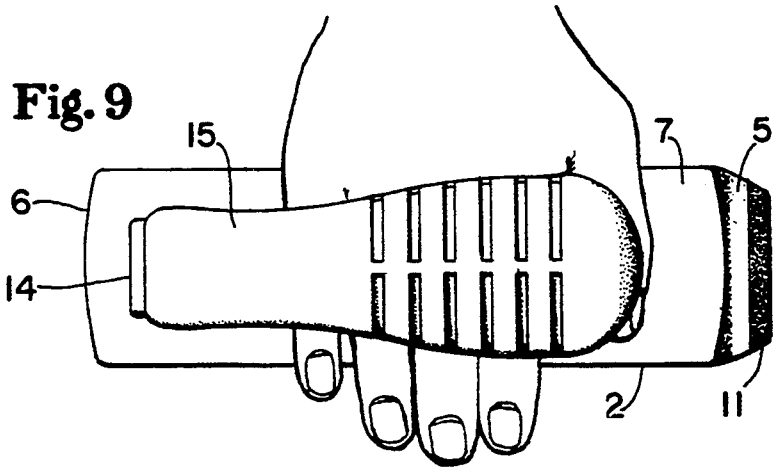
FIGS. 9 and 10 are respectively a plane view and a side elevational of the scrub brush of the present invention illustrating "no-grip" engagements of the scrub brush by the user's hand.
Figure 10:
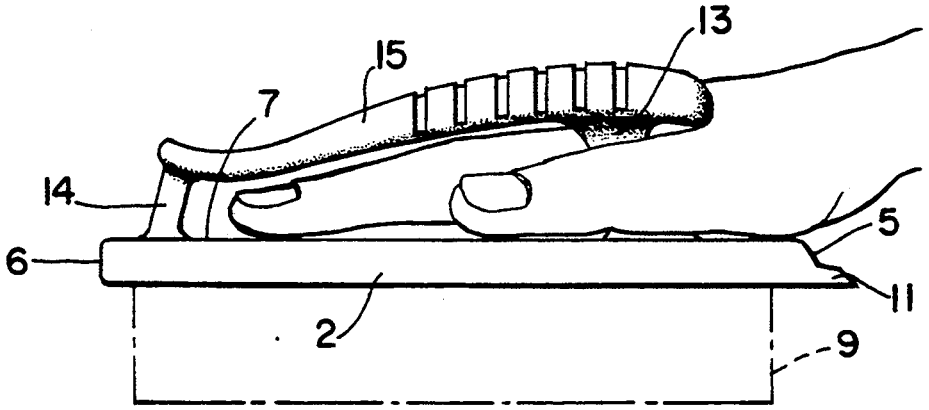

FIGS. 9 and 10 illustrate "no-grip" engagements of the brush by the user's hand. These engagements may be used in instances where the user's hand is for one reason or another impaired and incapable of a true grasping or gripping action such as those illustrated in FIGS. 5–8.

In FIG. 9, the user simply inserts his fingers beneath the grip 15 between supports 13 and 14, with the thumb engaging the top surface 7 of the bristle block 2 forwardly of support 13. In this manner, the brush will be adequately engaged for a scrubbing action, and the user's hand can apply pressure to the top surface 7 of the bristle block 2.

In the exemplary engagement illustrated in FIG. 10, the user places his hand on the upper surface 7 of the bristle block 2 from the forward end thereof. In this instance, support 13 is engaged between the user's thumb and index finger, with the thumb engaging the top surface 7 of the bristle block to one side of support 13 and the index finger engaging the top surface 7 of the bristle block 2 on the opposite side of support 13.

From the examples set forth in FIGS. 5–10, the versatility of the brush and its handle will be apparent. In all of the exemplary grips of FIGS. 5–8, the heel of the user's hand is automatically properly positioned to apply direct pressure for easier, more natural hands and knees type scrubbing. As indicated above, the flexibility of hand positioning permits frequent change by the user, thereby minimizing weariness from hand strain. By virtue of its configuration, the brush can be adequately grasped, while requiring less grasping force.

Modifications may be made in the invention without departing from the spirit of it.

What is claimed:

1. A scrub brush having a bristle block body with longitudinal sides, forward and rearward ends, and top and bottom surfaces, an array of scrubbing bristles extending downwardly from said bristle block bottom surface, a handle for said scrub brush comprising a grip having forward and rearward ends and extending longitudinally of said bristle block, together with a pair of supports extending between the bristle block top surface and the grip near said forward and rearward ends of said grip, said forward end of said grip overhanging said adjacent one of said supports thereabouts, said grip having a gentle S-curved longitudinal configuration, the distance between said forward end of said grip and said top surface of said bristle block being slightly greater than the distance between said rearward end of said grip and said top surface of said bristle block, said grip increasing slightly in width and thickness from said rearward end to said forward end thereof.

2. The scrub brush claimed in claim 1 wherein said forward end of said grip is rounded as viewed in plan.

3. The scrub brush claimed in claim 1 including a scraper located at said forward end of said bristle block having a forwardmost scraping edge extending transversely of said bristle block.

4. The scrub brush claimed in claim 3 wherein said bristle block, handle and scraper comprise an integral, one-piece molded structure.

5. The scrub brush claimed in claim 1 wherein said top surface of said bristle block is substantially planar.

6. The scrub brush claimed in claim 1 wherein said grip is spaced from said top surface of said bristle block by a distance no greater than will allow the comfortable receipt of the user's fingers therebetween.

7. The scrub brush claimed in claim 1 wherein said grip has a top surface provided with transversely extending grooves therein whereby to increase the frictional engagement between said top surface and the user's hand.

8. The scrub brush claimed in claim 1 wherein said grip has a top surface abutable by the heel of the user's hand when the brush is oriented with said forward end of said bristle block facing toward or away from the user.

9. The scrub brush claimed in claim 8 wherein said top surface of said bristle block is substantially planar.

10. The scrub brush claimed in claim 9 wherein said grip is spaced from said top surface of said bristle block by a distance no greater than will allow the comfortable receipt of the user's fingers therebetween.

11. The scrub brush claimed in claim 10 wherein said forward end of said grip is rounded as viewed in plan.

12. The scrub brush claimed in claim 11 including a scraper located at said forward end of said bristle block having a forwardmost scraping edge extending transversely of said bristle block.

13. The scrub brush claimed in claim 12 wherein said grip has a top surface provided with transversely extending grooves therein whereby to increase the frictional engagement between said top surface and the user's hand.

14. The scrub brush claimed in claim 13 wherein said bristle block, handle and scraper comprise an integral, one-piece molded structure.

* * * * *